United States Patent [19]

Magazzi

[11] Patent Number: 4,832,338

[45] Date of Patent: May 23, 1989

[54] MULTIPURPOSE GOLF GAME UTENSIL

[76] Inventor: Michael Magazzi, 3828 Sunney Valley Rd., New Milford, Conn. 06776

[21] Appl. No.: 166,693

[22] Filed: Mar. 14, 1988

[51] Int. Cl.[4] ..... A63B 55/10; F16M 13/00

[52] U.S. Cl. ..... 273/32 A; 273/32 E; 273/162 R; 248/530

[58] Field of Search ..... 273/32 R, 32 A, 32 B, 273/32 D, 32 E, 194 R, 162 R, 162 D, 162 F; 211/70.2; 206/315.2; 224/918; 248/530, 359, 359 G; D8/354; D21/223; 124/23 R

[56] References Cited

U.S. PATENT DOCUMENTS 3,828,757 8/1974 Finlay ..... 124/41 A

*Primary Examiner*—Richard C. Pinkham
*Assistant Examiner*—S. Passaniti
*Attorney, Agent, or Firm*—Joseph R. Carvalko, Jr.

[57] ABSTRACT

This invention relates to a device which serves as a stand for a golf club. In addition the device can be used to mark the location of the ball, clean the accumulation of debris from the bottom of the golfer's shoe, and clean the debris often formed on the face of a golf club. The device consists of a rod with various bends so as to lodge a golf club. The rod is covered with a frictional material to aid in the balance of the golf club. There is a first vertical member which is used to stand the device erect in the ground. Above and connected to the vertical member is a C-shaped frame which is used to support the shaft and head of a golf club when the club is not in use. The first standing member has a spiked end for facilitating the insertion of the device into the ground. The spiked end is also used to remove dirt and grass from the sole and heel of the golf shoes, as well as to scrape dirt that may be lodged in the grooves of a golf club's face.

4 Claims, 1 Drawing Sheet

MULTIPURPOSE GOLF GAME UTENSIL

BACKGROUND OF THE INVENTION

1. Field of the Invention

This invention relates to golf game utensils that are intended to provide convenience for the golfer and particularly to a device which primarily serves as a stand for a golf club. In addition the device can be used to mark the location of the ball, clean the accumulation of debris from the bottom of the golfer's shoe, and clean the debris often found on the face of golf clubs.

2. Description of the Prior Art

The prior art describes numerous types of devices that assist people participlating in athletic activities such as golf, tennis, bowling, etc. For example, in U.S. Pat. No. 2,564,318, Wick, describes a golf club carrier that can be permanently stationed on the golf course while the golfer attends to the game; U.S. Pat. No. 2,737,990 disclosed another form of golf club carrier which holds multiple clubs and golf balls; still U.S. Pat. No. 2,858,868 discloses another type of a golf club carrier that allows the golfer to carry the golf clubs from hole to hole, yet use the carrier as a golf club stand when the golfer decides to attend to the game.

While each of the devices described in the prior art are for carrying and then holding the clubs, they do present some shortcomings. Each, for example, is generally a replacement for the conventional golf bag. Since most golfers still use golf bags these devices merely duplicate the carrying function and are only useful when the golfer wants a place to temporarily store the golf clubs. Each of the prior art carriers are almost as large or as cumbersome as a golf bag and the inconvenience of carrying both the golf bag and one of these carriers outweighs their limited utility.

Furthermore, none of the devices described in the prior art can also be utilized as a ball marker and alternatively as a means for cleaning debris that accumulates between the spikes on golf shoes or within the ridges generally found on the face of a golf club, and also repair divots which the golfer may cause as a result of driving the ball on the golf course.

SUMMARY OF THE INVENTION

It is therefore an object of the present invention to provide a lightweight, portable, and low cost device that can be used: (i) primarily as a stand for a golf club; (ii) to mark the spot of a golf ball; (iii) to clean debris from the golfer's shoes; (iv) to clean debris from the golf club; (v) to repair divots on the golf course; (vi) to keep the golf club off the ground and dry.

The foregoing objects and others are accomplished in accordance with the present invention by providing a frame-like device approximately 6 inches in height which when spiked into the ground can be used to support a golf club or mark the spot of a ball.

The device is formed from a metal rod, although plastic or other formable materials could be used, of essentially uniform thickness and a single length. The rod is formed such that there is a first vertical standing member substantially 3 to 6 inches in length from one end of the rod. The rod is then bent forming a first substantially horizontal member. The first horizontal member extends along a slight incline for approximately 1 to 3 inches at which point it bends upwardly to form a second vertical upward member, which is approximately 2 to 3 inches in length. At approximately the 2 or 3 inch point along the second vertical upward member, this member is bent to form a second horizontal member. The second horizontal member contains a means, such as a snap, for attaching the device to a golf bag or the golfer's clothing.

The first vertical standing member has a spiked end for facilitating the insertion of the device into the ground. The spiked end is also used to remove dirt and grass from the sole and heel of the golf shoes, as well as to scrape dirt that may be lodged in the grooves of a golf club's face.

The first horizontal member is covered over with a material which has a high coefficient of friction, such as rubber. the second horizontal member is also covered over with a material which has a high coefficient of friction such as rubber. In addition the frictional material is colored so as to allow for greater viability on the golf course.

A golf club is held upright in the device when the device is inserted firmly into the ground, generally 2 inches above the spike, and the golf club is caused to be lodged between the first horizontal member and the second horizontal member. When the golf club is stable and erect the face of the club abuts the first horizontal member and the shaft of the club presses against the surface of the material covering the second horizontal member.

The inventor has found that to improve stability of the device, a second vertical standing member extending from the first horizontal member and parallel with the first vertical standing member can be incorporated. This second leg prevents the device from rotating when the device is inserted into the ground.

Upon one of the vertical or horizontal legs there is a means for adapting a ball marker or small flag which the golfer may require when he temporarily removes his ball from the golf course and desires to mark the ball's location. The covering materials are also brightly colored so as to improve its visibility.

BRIEF DESCRIPTION OF THE DRAWING

For better understanding of the invention as well as other objects and further features thereof, reference is made to the following detailed disclosure of this invention taken in conjunction with the accompanying drawing wherein.

DESCRIPTION OF THE PREFERRED EMBODIMENT

Figure 1:
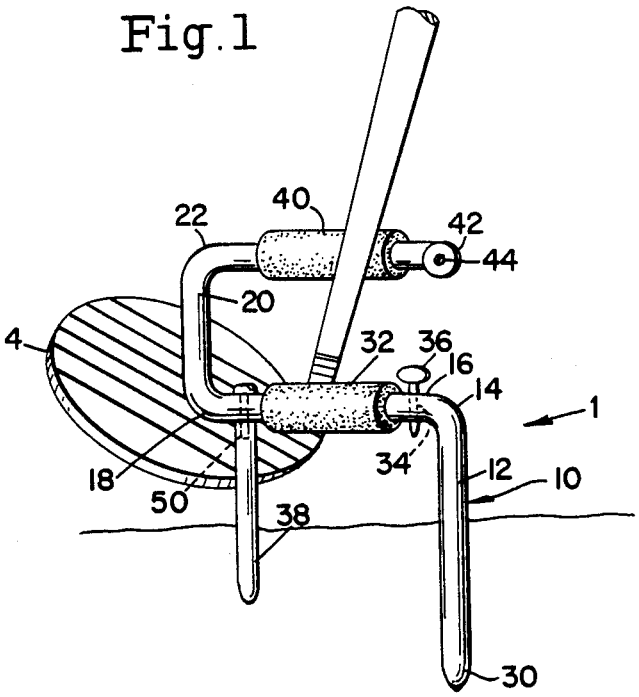
FIG. 1 illustrates the device inserted into the ground supporting a golf club 4.

FIG. 1 shows the preferred embodiment as comprised of a rod 10 of uniform thickness and a single length made from a formable material such as plastic or metal. The inventor has found that 5/16 inch cold rolled steel provides the best choice among competing materials for formability, ruggedness and remaining relatively lightweight and low cost.

A first vertical member 12 is approximately 4 inches in length, although the vertical length of member 12 is not critical. If it is too short, however, the utensil will not seat itself well across the variety of golf course ground conditions one normally encounters.

A first vertical standing member 12 is bent 14 so as to form a first substantially horizontal member 16.

A second vertical standing member 38 can be employed to improve stability. The second vertical standing member extends downwardly from the first horizontal member in the vicinity of the bend 18. The attachment 50 of the second vertical standing member 38 is either a weldment or screw-like fastener 50.

It is not essential that the horizontal member 16 be absolutely parallel with the ground or perpendicular to the first vertical standing member 12. The first bend 14 is approximately in the range of 90 degrees to 120 degrees. To achieve greatest stability in balancing the golf club in an upright position the horizontal member 16, should have a slight incline.

The first horizontal member 16 is approximately $2\frac{1}{4}$ inches plus or minus $\frac{1}{4}$ inch in length and also has the bend 18 substantially at right angle or 90 degrees to form an upwardly vertical member 20.

The vertical member 20 is also approximately $2\frac{1}{4}$ plus or minus $\frac{1}{4}$ inch in length and has the bend 22 substantially at a right angle or 90 degrees to form the second horizontal member 24.

The second horizontal member 24 terminates in a final bend 26 creating a third horizontal member 28.

As an accessory to aid the golfer there is a ball marker 36 or flag which is inserted into a through hole 34 on the upper surface of the first horizontal member 16.

There is a means 42 to attach the device 1 to either a golf bag, belt buckle or other article worn or carried by the golfer, which must support a mating a snap attachment. A first mating snap 44 secured to a third horizontal member 28 using a small threaded screw or other means attaches the snap 44 to the third horizontal member 28. The member 28 is formed by a bend 26 at the terminal end of member 44. The length of member 28 should be at least $\frac{1}{4}$ inch. The inventor has found that when the member 28 is approximately 1 inch in length, excluding the snap 44, it accommodates conventional snap devices.

The first horizontal member 16 must have a surface that will aid the golf club face in not slipping. A rough surface, mechanically or chemically abraded can suffice, although a covering with a material with a high coefficient of friction such as a covering of a rubber sleeve 32 has been found to work well.

The second horizontal member 24 also requires a high degree mechanical resistance and a covering such as a rubber sleeve 40 which has a high coefficient of friction is found to suffice.

In one embodiment the rubber sleeve 32 is one long tube covering substantially the entire surface of the rod 10 running up the first vertical member 12, over the first horizontal member 16, continuing up the second vertical member 20, across the second horizontal member 24, and terminating at the end of the means 42 to attach the snap 44.

In an alternate embodiment the first vertical member 12 has its terminus shaped into a point 30 so as to be usable as a scrapper for scraping dirt and debris from the golfer∝s shows and the face of the golf club. The entire device can be used as a tool for repairing turf divots.

The utensil, when used to support a golf club 4, employs principals of static balance and friction that exist between the major components; the utensil's two horizontal members and the golf club.

Figure 2:
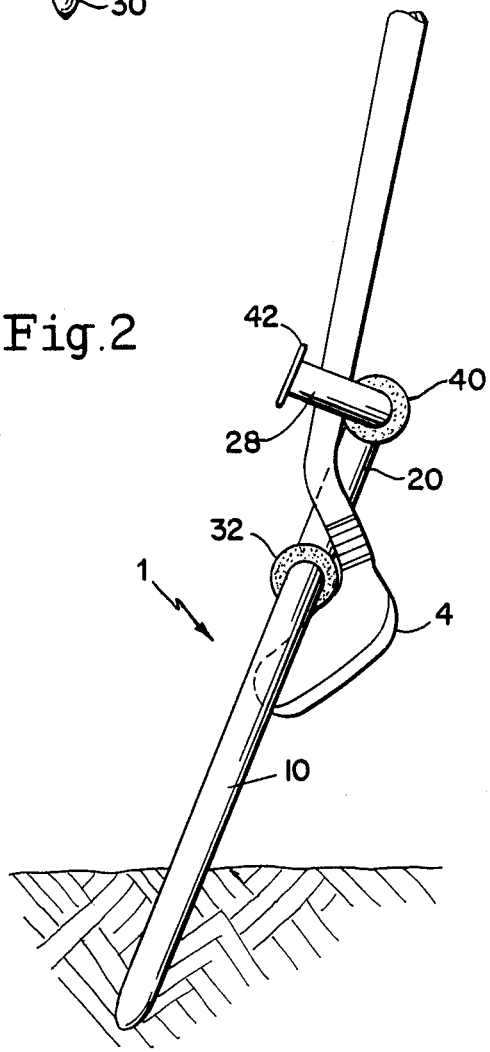
FIG. 2 is a perspective view of the device showing the full view of the golf club.

As illustrated in FIG. 2 the golf club is stabilized in an upright position when the golf club head and the golf club shaft are balanced by the normal and frictional forces present at the first horizontal member 16 and the second horizontal member 24, when the device 1 is inserted into the ground at an angle slightly off-vertical position. The rotational moment created by the shaft's center of gravity and its moment arm (as measured from the second horizontal member 24 to the center of gravity of the shaft) tends to force the golf club head against the frictional material 32. The vectorial sum of the normal forces against first horizontal member 24 and the frictional forces at the interface of the rubber sleeves 32 and 40 on the horizontal members provide an equal and opposite force exerted by the shaft's weight against the horizontal member 24 and the frictional forces of the rubber sleeve 32, thus the golf club remains in an upright position.

Therefore, having described the preferred embodiment and alternate embodiments, it will be mentioned that the accompanying drawings and descriptions may be altered to suit versions with the same effect of the intended patent. For these reasons the claims are intended to capture the spirit and scope of the present invention.

I claim:

1. A golf game utensil comprising:

a metal rod of uniform thickness and single length, having a first vertical standing member substantially 4 inches in length which terminates at a bend substantially in the range of 90 degrees to 120 degrees forming, a first horizontal member substantially $2\frac{1}{4}$ inches in length which terminates at a bend substantially 90 degrees forming, a second vertical member substantially $2\frac{1}{4}$ inches in length which terminates at a bend substantially 90 degrees forming, a second horizontal member substantially 2 inches in length which terminates at a bend substantially 90 degrees forming, a final horizontal member at least 1/4 inch in length such that, the first horizontal member is covered with a material having a high coefficient of friction, and includes a means for inserting a ball member, and has attached a second vertical member for preventing the device from moving when staked into the ground, and the second horizontal member is covered with a material having a high coefficient of friction, and, the final horizontal member has attached to its terminal end a means for attachment to a golf bag when the utensil is not in use.

2. A golf game utensil comprising:

a metal rod of uniform thickness and single length, having a first vertical standing member substantially 4 inches in length which terminates at a bend substantially in the range of 90 degrees to 120 degrees forming, a first horizontal member substantially $2\frac{1}{4}$ inches in length which terminates at a bend substantially 90 degrees forming, a second vertical member substantially $2\frac{1}{4}$ inches in length which terminates at a bend substantially 90 degrees forming, a second horizontal member substantially 2 inches in length which terminates at a bend substantially 90 degrees forming, a final horizontal member at least $\frac{1}{4}$ inch in length such that, the first horizontal member is covered with a material having a high coefficient of friction, and includes a means for inserting a ball marker, and has attached a second vertical member for preventing the device from moving when staked into the ground, and the second horizontal member is covered with a material having a high coefficient of friction, and, the final horizontal member has attached to its terminal end a means for attachment to a golf bag when the utensil is not in use wherein the first substantially horizontal member contains a means for marking the golf ball's location.

3. A golf game utensil comprising:

a metal rod of uniform thickness and single length, having a first vertical standing member substantially 4 inches in length which terminates at a bend substantially in the range of 90 degrees to 120 degrees forming, a first horizontal member substantially $2\frac{1}{4}$ inches in length which terminates at a bend substantially 90 degrees forming, a second vertical member substantially $2\frac{1}{4}$ inches in length which terminates at a bend substantially 90 degrees forming, a second horizontal member substantially 2 inches in length which terminates at a bend substantially 90 degrees forming, a final horizontal member at least $\frac{1}{4}$ inch in length such that, the first horizontal member is covered with a material having a high coefficient of friction, and includes a second vertical member for preventing the device from moving when staked into the ground, and the second horizontal member is covered with a material having a high coefficient of friction, and, the final horizontal member has attached to its terminal end a means for attachment to a golf bag when the utensil is not in use, wherein the terminal end of the first vertical member has a spiked end.

4. The golf game utensil of claim 1 in combination with a golf club.

* * * * *